US009103537B2

(12) United States Patent
Maeng

(10) Patent No.: US 9,103,537 B2
(45) Date of Patent: Aug. 11, 2015

(54) HEAT-DISSIPATING APPARATUS AND ILLUMINATOR USING THE SAME

(75) Inventor: Seoyoung Maeng, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 876 days.

(21) Appl. No.: 12/886,722

(22) Filed: Sep. 21, 2010

(65) Prior Publication Data

US 2011/0068685 A1 Mar. 24, 2011

(30) Foreign Application Priority Data

Sep. 23, 2009 (KR) ..... 10-2009-0089868

(51) Int. Cl.
*F21V 29/02* (2006.01)
*F21K 99/00* (2010.01)
*F21Y 101/02* (2006.01)

(52) U.S. Cl.
CPC . *F21V 29/02* (2013.01); *F21K 9/00* (2013.01); *F21Y 2101/02* (2013.01)

(58) Field of Classification Search
CPC ..... F21V 29/004; F21V 7/09; F21V 7/04; F21Y 2103/00; F21Y 2101/02; F21S 48/1388; F21S 48/215; F21S 48/1154; F21K 9/00
USPC ..... 362/218, 298, 373, 547; 313/11, 35; 257/722; 361/676, 677, 678
See application file for complete search history.

(56) References Cited

U.S. PATENT DOCUMENTS

| | | | | |
|---|---|---|---|---|
| 6,123,145 | A | 9/2000 | Glezer et al. | |
| 7,097,328 | B2 * | 8/2006 | Shemitz et al. | 362/264 |
| 2002/0195232 | A1 * | 12/2002 | Katsui | 165/104.33 |
| 2009/0056918 | A1 * | 3/2009 | Li et al. | 165/104.33 |
| 2009/0086416 | A1 * | 4/2009 | Ishikawa et al. | 361/679.01 |
| 2010/0225220 | A1 * | 9/2010 | Tanaka et al. | 313/46 |

FOREIGN PATENT DOCUMENTS

| | | | |
|---|---|---|---|
| JP | 2006-055741 | A | 3/2006 |
| KR | 10-2006-0113467 | A | 11/2006 |

* cited by examiner

*Primary Examiner* — Jong-Suk (James) Lee
*Assistant Examiner* — Mark Tsidulko
(74) *Attorney, Agent, or Firm* — Birch, Stewart, Kolasch & Birch, LLP

(57) ABSTRACT

Disclosed is a heat-dissipating apparatus and an illuminator using the same. The heat-dissipating apparatus includes a heat sink including one side contacted with a heat generating portion and the other side having heat-dissipating pins arranged at the edge thereof and a space formed inside the heat-dissipating pins; and a driver that is positioned in the space and keeps the heat-dissipating pins cool by sucking outside air and discharging inside air with a pumping operation.

18 Claims, 14 Drawing Sheets

WHEN SUCKING AIR (10a)

WHEN DISCHARGING AIR (10b)

(11a)

(11b)

(13a)

(13b)

HEAT-DISSIPATING APPARATUS AND ILLUMINATOR USING THE SAME

Pursuant to 35 U.S.C. §119 (a), this application claims the benefit of earlier filing date and right of priority to Korean Patent Application No. 10-2009-0089868, filed on Sep. 23, 2009, the contents of which are hereby incorporated by reference in their entirety.

BACKGROUND OF THE DISCLOSURE

1. Field of the Invention

The present disclosure relates to a heat-dissipating apparatus and an illuminator using the same.

2. Description of the Related Art

Recently, electronic apparatus such as an illuminator, a display, and a portable terminal is on the increase in terms of performance and speed, and the trend toward miniaturization light weight, compactness and slimness is also progressing rapidly.

Users using electronic devices require high performance in a smaller area and the electronic devices are also being grafted onto integration and high performance technologies.

As electronic devices increase in performance and speed, the electronic devices generate a large amount of heat, and due to the high-temperature heat, the trouble generation ratio in the driving devices of the electronic devices becomes high. Accordingly, a self heat-dissipating design is needed.

Additionally, there is needed a heat-dissipating apparatus that easily dissipates heat generated in the heat generation area by being attached to the heat generation area of the electronic devices.

SUMMARY OF THE INVENTION

In one general aspect of the present disclosure, a heat-dissipating apparatus includes a heat sink including one side contacted by a heat generating portion and the other side having heat-dissipating pins arranged at the edge thereof and a space formed inside the heat-dissipating pins; and a driver positioned in the space on keeping the heat-dissipating pins cool by sucking outside air and discharging inside air with a pumping operation.

In some exemplary embodiments, the driver may include a housing formed with both sides being opened, vacant inside, and a plurality of air flow slots; first and second vibrating plates that are mounted on both open sides of the housing, respectively; and an actuator vibrating the first and second vibrating plates to discharge air inside the housing through the plurality of air flow slots and suck air outside the housing through the plurality of air flow slots.

In some exemplary embodiments, the actuator may include a first actuator to vibrate the first vibrating plate; and a second actuator to vibrate the second vibrating plate.

In some exemplary embodiments, the first and second actuators may be actuators to respectively vibrate the first and second vibrating plates using electromagnetic force generated between a magnet and a coil.

In some exemplary embodiments, the first vibrating plate has first and second guide portions installed thereon, the guide portions being separated each other, the second vibrating plate has third and fourth guide portions installed thereon, and a supporting portion is suspended from an inner wall of the housing; the first actuator includes first and second magnets mounted on an inner wall of the housing, the magnets being separated each other and having upper and lower portions that are different in their polarities; and first and second coils oppositely separated from the first and second magnets, respectively, and wound on the first and second guide portions, respectively; and the second actuator includes third and fourth coils wound on the third and fourth guide portions, respectively; and a third magnet oppositely separated from the third and fourth coils and fixed to the supporting portion.

In some exemplary embodiments, the housing may have a plurality of projections formed on the lower surface of the housing, or a plurality of projections formed on the heat sink.

In some exemplary embodiments, the heat-dissipating pins may be arranged oppositely to the plurality of air flow slots formed in the housing, respectively.

In some exemplary embodiments, the heat-dissipating pins may respectively include bending areas.

In some exemplary embodiments, the heat generating portion may include a light emitting diode illuminator, a central processing unit, a back light, a display apparatus, a hard disk drive, a portable terminal, a notebook computer, a computer module, and a projector.

In some exemplary embodiments, a sinusoidal wave current may be applied to the first to fourth coils such that the first and second vibrating plates move up and down so as to be vibrated by the electromagnetic force generated by the first to fourth coils and the first to third magnets.

In another general aspect of the present disclosure, an illuminator includes a heat sink having a plurality of pins formed thereon; an active cooling portion that is connected to the heat sink and can cool the heat sink by sucking or discharging outside air with a pumping operation; and light emitting diodes emitting light, where generated heat is transferred to the heat sink.

In some exemplary embodiments, the heat sink may have an opening through which air is circulated.

In some exemplary embodiments, the heat sink may have a through hole formed therein, a socket having a driver to drive the light emitting diodes is inserted into the through hole, and an E-base electrode structure connected to the socket is projected outside the heat sink.

In some exemplary embodiments, the heat sink may have a through hole formed therein, a socket having a driver to drive the light emitting diodes is inserted into the through hole, and a pair of leads connected to the socket is projected outside the heat sink.

In some exemplary embodiments, the illuminator may further include a diffuser diffusing and transmitting light emitted from the light emitting diodes.

In some exemplary embodiments, the illuminator may further include a printed circuit board on which the light emitting diodes are mounted.

In some exemplary embodiments, the plurality of pins may be formed on the side of the heat sink, and the light emitting diodes are positioned in an inner area of the heat sink.

In some exemplary embodiments, the heat sink may be coupled with a case, where an active cooling portion is embedded.

In some exemplary embodiments, the plurality of pins may be bent in a predetermined direction.

In some exemplary embodiments, the active cooling portion may include a housing formed with both sides being opened, vacant inside, and a plurality of air flow slots; first and second vibrating plates respectively mounted on both open sides of the housing; and an actuator vibrating the first and second vibrating plates to discharge air inside the housing and suck air outside the housing through the plurality of air flow slots.

The heat-dissipating apparatus of the present disclosure has an advantageous effect that heat generated at the heat generating portion and transferred to the heat sink and heat-dissipating pins can be efficiently dissipated by air flown by a pumping operation of the driver positioned inside the heat-dissipating pins.

Further, the heat-dissipating apparatus of the present disclosure has an advantageous effect that air suction and discharge are repeatedly performed while controlling the pressure of air inside the housing, by vibrating the vibrating plate, and high pressure air is contacted with the heat-dissipating pins outside the housing, thereby enhancing the heat-dissipating efficiency.

Further, the heat-dissipating apparatus of the present disclosure has an advantageous effect that air suction and discharge are performed using a plurality of air flow slots formed in the housing to increase the pressure of air jetted to the heat-dissipating pins from the inner housing much more, thereby quickening cooling of the heat transferred to the heat-dissipating pins.

Further, the heat-dissipating apparatus of the present disclosure has an advantageous effect that the housing has both vibrating plates formed on both opened sides of the housing, respectively, and first and second vibrating phases are driven such that their vibrating phases can be opposite to each other, so that most of vibrating transferred to outside from the driver can be cancelled with opposite vibrating phases of the first and second vibrating plates.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description, serve to explain the principle of the disclosure. In the drawings.

DETAILED DESCRIPTION OF THE PREFERRED EMBODIMENTS

Hereinafter, an embodiment of the present disclosure will be described with reference to the accompanying drawings.

Figure 1:
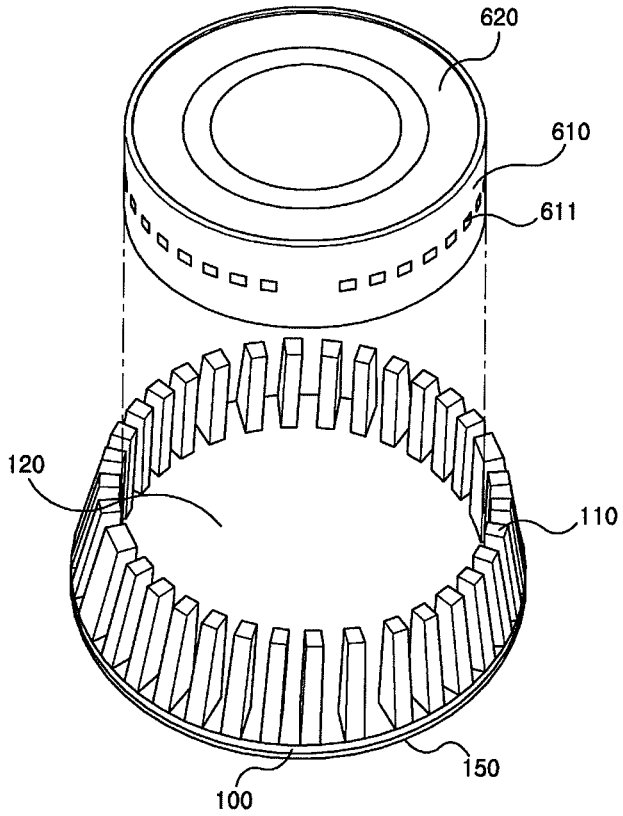
FIG. 1 is a conceptual perspective view explaining a heat-dissipating apparatus according to the present disclosure.

FIG. 1 is a conceptual perspective view explaining a heat-dissipating apparatus according to the present disclosure.

The heat-dissipating apparatus according to the present disclosure is constructed of a heat sink 100 including one side 101 contacted with a heat generating portion and the other side 102 having heat-dissipating pins 110 arranged at the edge thereof and a space 120 formed inside the heat-dissipating pins 110; and a driver 600 that is positioned in the space 120 and keeps the heat-dissipating pins 110 cool by sucking outside air and discharging inside air with a pumping operation.

The driver 600 is constructed of a housing 610 that has both sides opened, is vacant inside and has a plurality of air flow slots 611 formed therein; first and second vibrating plates 620 and 621 that are mounted on both open sides of the housing 610, respectively; and an actuator that vibrates the first and second vibrating plates 620 and 621 to discharge air inside the housing through the plurality of air flow slots and suck air outside the housing 610 through the plurality of air flow slots 611.

Figure 2:
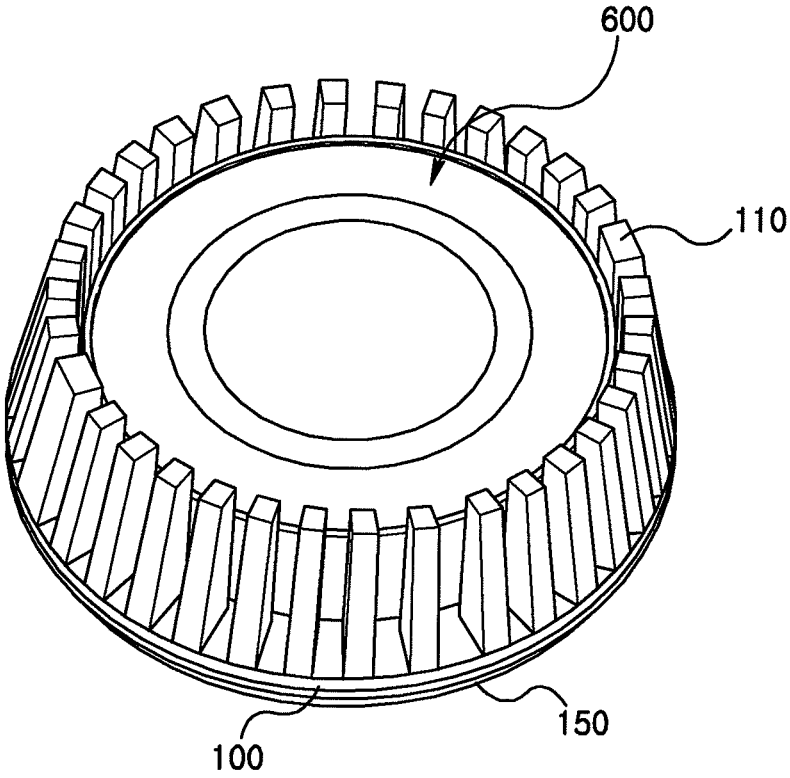
FIG. 2 is a perspective view showing an assembled state of a heat-dissipating apparatus according to the present disclosure.

FIG. 2 is a perspective view showing an assembled state of a heat-dissipating apparatus according to the present disclosure.

A driver 600 is positioned in the space formed inside the heat-dissipating pins 110 of the heat sink 100, which cools the heat-dissipating pins 110 by circulating air compulsorily.

At this time, the driver 600 circulates air compulsorily using a pumping operation to suck inside air and discharge outside air, and the circulating air is contacted with the heat-dissipating pins 110 at a predetermined pressure.

Therefore, the heat generated in a heat generating portion 150 and transferred to the heat sink 100 and the heat-dissipating pins 110 can be cooled by the air circulating with the pumping operation of the driver 600 positioned inside the heat-dissipating pins 110.

Meanwhile, the heat generating portion 150 is defined as an electronic apparatus that generates heat when it is driven, which has a variety of application areas such as an illuminator (an LED (Light Emitting Diode) illuminator, especially), a control device (a CPU (Central Processing Unit), especially), a back light, a display apparatus, a hard disk drive, a portable terminal, a notebook computer, a computer module, and a projector.

Figure 3:
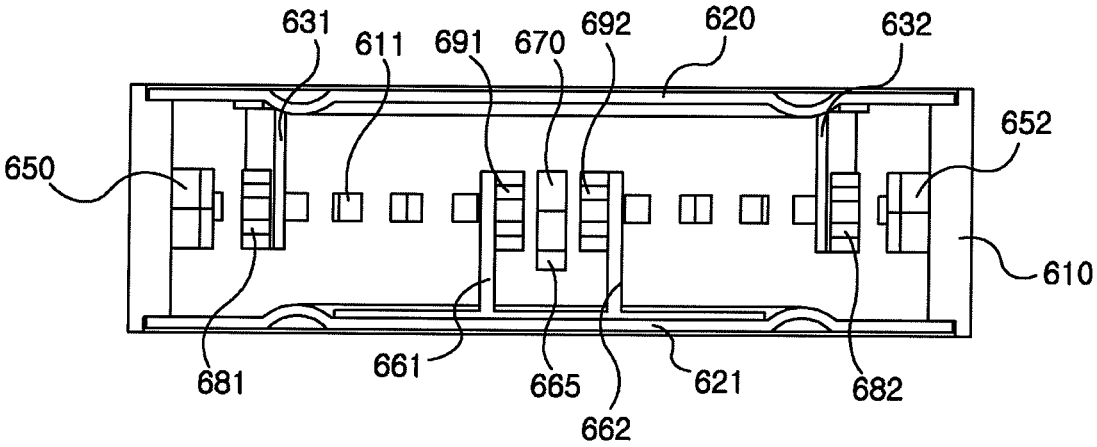
FIG. 3 is a schematic sectional view explaining a driver of a heat-dissipating apparatus according to the present disclosure.

FIG. 3 is a schematic sectional view explaining a driver of a heat-dissipating apparatus according to the present disclosure.

The driver of the heat-dissipating apparatus may include actuators that drive the first and second vibrating plates 620 and 621, respectively.

That is, the first and second vibrating plates 620 and 621 are mounted on both open sides of the housing 610, respectively, and the actuators is comprised of a first actuator to vibrate the first vibrating plate 620; and a second actuator to vibrate the second vibrating plate 621.

As such, the heat-dissipating apparatus according to the present disclosure drives the first and second actuators to discharge air inside the housing 610 though the air circulating slots 611 and suck air outside the housing 610 through the circulating slots 611.

Further, the first and second vibrating plates 620 and 621 seal the housing 610 so that the air inside the housing 610 should be jetted to the plurality of air flow slots 611. Therefore, air pressure jetted to the plurality of air flow slots 611 becomes high and the heat-dissipating pins are contacted with the air at a high jet pressure, thereby increasing heat-dissipating efficiency.

An example of the first and second actuators will be described in detail.

First, the first vibrating plate 620 has first and second guide portions 631 and 632 mounted therein, the guide portions being separated each other, and the second vibrating plate 621 has third and fourth guide portions 661 and 662 mounted therein. A supporting portion 665 is suspended on the inner wall of the housing 610.

At this time, the first actuator is constructed of first and second magnets 651 and 652 that are separately mounted on the inner wall of the housing 610 and have upper and lower portions whose polarities are different, respectively; and first and second coils 681 and 682 that are opposite to and separated from the first and second magnets 651 and 652, respectively, and wound around the first and second guide portions 631 and 632, respectively.

Further, the second actuator is constructed of third and fourth coils 691 and 692 wound around the third and fourth guide portions 661 and 662, respectively; and a third magnet 670 that is opposite to and separated from the third and fourth coils 691 and 692, respectively, and fixed to the supporting portion 665.

The first to third magnets 651, 652 and 670 of the first and second actuators, and the first to fourth coils 681, 682, 691 and 692 that are opposite to and separated from the magnets generate electromagnetic force, and the first and second vibrating plates 620 and 621 are vibrated by the electromagnetic force.

Further, the heat-dissipating apparatus according to the present disclosure has an advantage that since the housing has vibrating plates formed on both open sides thereof and the first and second vibrating plates can be driven such that their vibrating phases are opposite to each other, most of vibration transferred outside from the driver can be cancelled using the opposite phases of the first and second vibrating plates.

Figure 4:
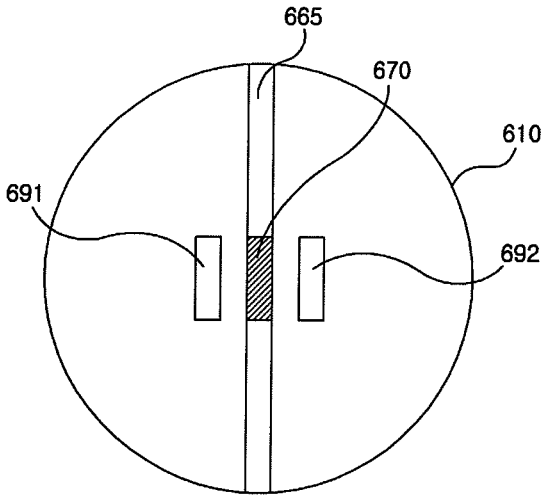
FIG. 4 is a schematic sectional view showing a third magnet fixed to a supporting portion according to the present disclosure.

FIG. 4 is a schematic sectional view showing a third magnet fixed to a supporting portion according to the present disclosure.

The second vibrating plate 621 has the third and fourth guide portions 661 and 662 mounted thereon, and the third and fourth coils 691 and 692 are wound around the third and fourth guide portions 661 and 662, respectively.

Therefore, while it is needed that magnet is mounted in order to generate electromagnetic force in corporation with the third and fourth coils 691 and 692, the present disclosure has a construction that the supporting portion 665 is suspended on the inner wall of the housing 610 and the third magnet 670 is fixed to the supporting portion 665.

At this time, it is desirable that the supporting portion 665 is fixed to one inner wall and the other inner wall of the housing 610 in order that it is supported to the housing as shown in FIG. 4.

Figure 5:
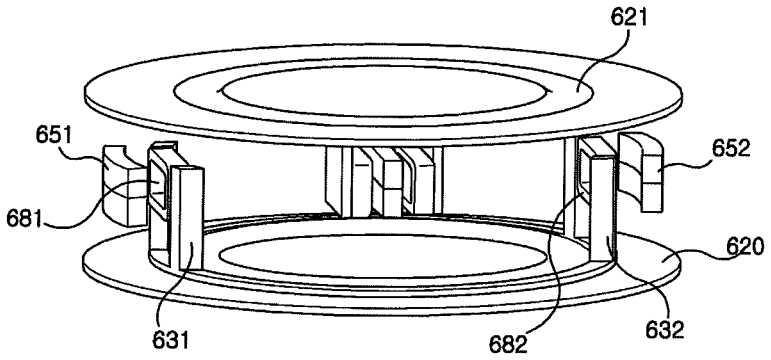
FIG. 5 is a schematic perspective view showing first and second vibrating plates that have a coil and a magnet, respectively, according to the present disclosure.
Figure 6:
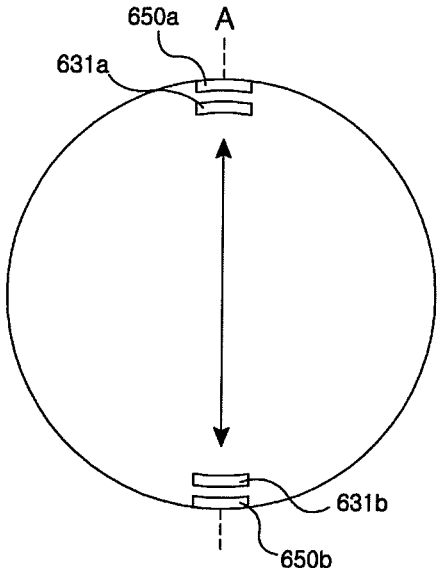
FIG. 6 is a schematic plane view explaining an example in which a magnet and a coil are arranged according to the present disclosure.

FIG. 5 is a schematic perspective view showing first and second vibrating plates that have a coil and a magnet, respectively, according to the present disclosure.

As described above, the first to third magnets 651, 652 and 670 and the first to fourth coils 681, 682, 691 and 692 construct the actuator to vibrate the first and second vibrating plates 620 and 621.

The actuator may be constructed of parts that use other forces to vibrate the first and second vibrating plates 620 and 621, in addition to the magnets and coils used to vibrate the first and second vibrating plates 620 and 621.

However, the present disclosure describes an actuator that includes magnets and coils to generate electromagnetic force, and discuses a construction of an embodiment in which the actuator is applied to the vibrating plates 620 and 621.

First, as shown in FIG. 5, the first to third magnets 651, 652 and 670 and the first to fourth coils 681, 682, 691 and 692 can be positioned between the first and second vibrating plates 620 and 621.

However, the magnets and coils may be arranged on the lower portion and upper portion of the first and second vibrating plates 620 and 621.

Further, the first and second coils 681 and 682 may be arranged oppositely to and separately from the first and second magnets 651 and 652, and the first and second magnets 651 and 652 and the first and second coils 681 and 682 serve to vibrate the first vibrating plate 620.

Further, the third and fourth coils 691 and 692 are arranged oppositely to and separately from both sides of the third magnet 670.

Meanwhile, when the number of pair of a magnet and a coil is plural, the pairs are arranged in an even number.

Further, in order to keep balance of force to vibrate the vibrating plates, one pair of the magnet 650*a* and the coil 631*a* is arranged at an area symmetrical to another pair of the magnet 650*b* and the coil 631*b*.

At this time, one pair of the magnet 650*a* and coil 631*a* and another pair of the magnet 650*b* and the coil 631*b* are on the same axis of 'A'.

Figure 7:
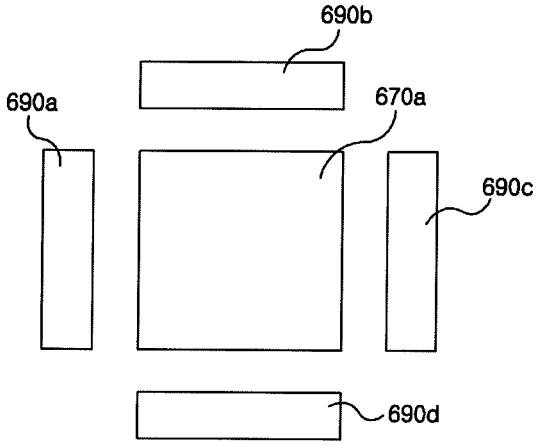
FIG. 7 is a schematic plane view explaining another example in which a magnet and a coil are arranged according to the present disclosure.

Further, a single magnet such as the third magnet 670 has coils arranged on its both sides, or when the shape of the single magnet is a square pillar 670*a* as shown in FIG. 7, coils 690*a*, 690*b*, 690*c* and 690*d* can be arranged in the four sides around the square pillar 670*a*, which are opposite to each other and separated from the pillar.

Figure 8:
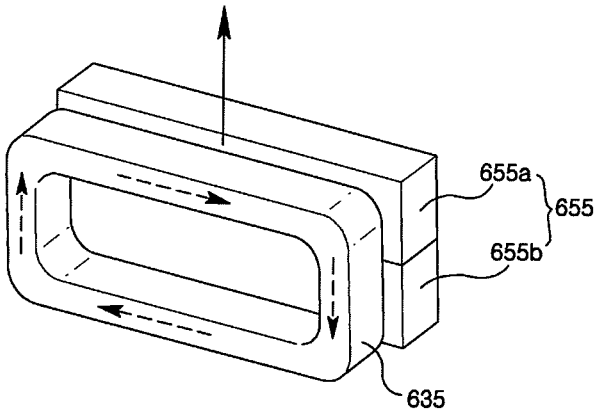
FIG. 8 is a schematic conceptual view explaining electromagnetic force generated between a magnet and a coil according to the present disclosure.

FIG. 8 is a schematic conceptual view explaining electromagnetic force generated between a magnet and a coil according to the present disclosure.

As shown in FIG. 8, the coil 635 is oppositely separated from the magnet 655 and the magnet 655 has upper and lower portions whose polarities are different from each other.

Here, the upper portion 655*a* of the magnet 655 has S-polarity and the lower portion 655*b* has S-polarity. When current flows through the coil 635 in the direction of arrow as shown in FIG. 8, electromagnetic force that is a force according to Fleming's left hand rule is generated between the magnetic flux generated by the magnet and the coil through which current flows, and the electromagnetic force is generated in the direction of the upper portion 655*a* of the magnet 655.

On the contrary, when current flows through the coil 635 in the reverse direction, electromagnetic force is generated in the direction of the lower portion 655*b* of the magnet 655.

The vibrating plates are moved up and down by the electromagnetic force generated between the magnet and coil, so that the vibrating plates can be vibrated.

Figure 9:
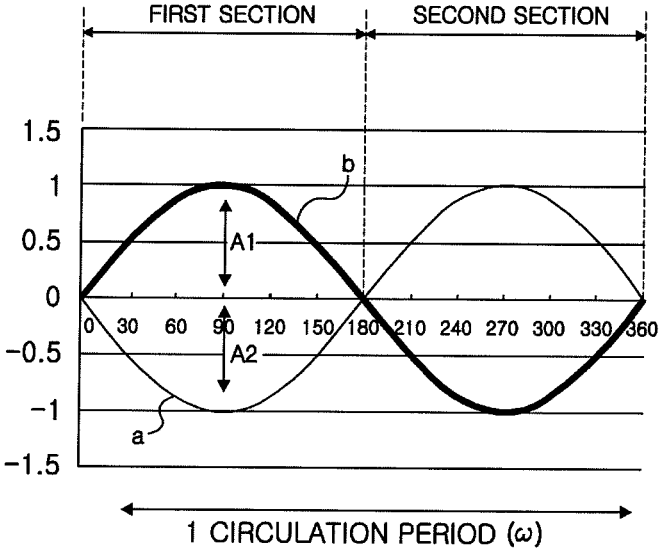
FIG. 9 is a waveform view of current applied to a coil according to the present disclosure.

FIG. 9 is a waveform view of current applied to a coil according to the present disclosure.

In the present disclosure, it is desirable that the vibrating plates are moved up and down by applying sinusoidal wave current to the coil.

In the sinusoidal wave current waveform view shown in FIG. 9, 'a' denotes a waveform view of current applied to the coil used to vibrate the first vibrating plate, and 'b' denotes a waveform view of current applied to the coil used to vibrate the first vibrating plate.

At this time, the vibrating plates are moved up in the positive (+) direction wave of the 'a' and 'b' and they are moved down in the negative (−) direction wave of the 'a' and 'b'.

Figure 10:
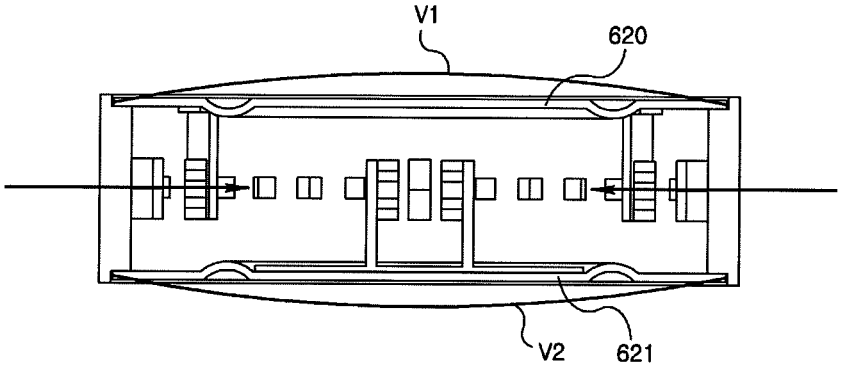
FIGS. 10*a* and 10*b* are conceptual sectional views explaining air suction and discharge in a driver according to the present disclosure.
Figure 10:
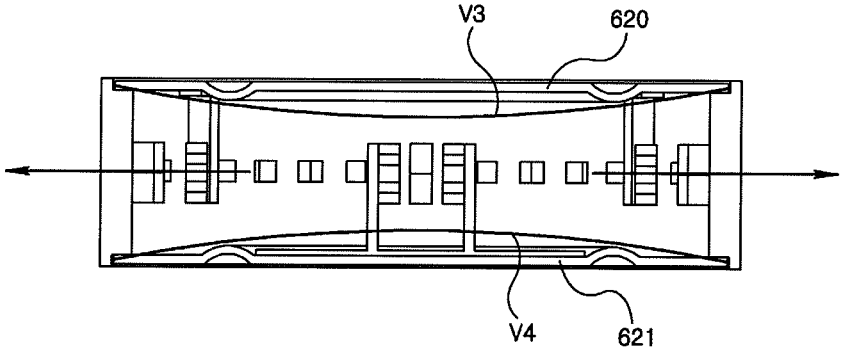

Therefore, in a first section, the waveform view 'a' is a positive (+) direction wave so that the first vibrating plate is moved up, and the waveform view 'b' is a negative (−) direction wave so that the second vibrating plate is moved down. So, as shown in FIG. 10*a*, the first and second vibrating plates 620 and 621 are moved up and down, respectively (trace of 'V1' and "V2' in FIG. 10*a*), so that air is sucked into the housing that has the first and second vibrating plates 620 and 621 mounted therein.

Further, in a second section, waveform view 'a' is a negative (−) direction wave so that the first vibrating plate is moved down, and the waveform view 'b' is a positive (+) direction wave so that the second vibrating plate is moved up. So, as shown in FIG. 10*b*, the first and second vibrating plates 620 and 621 are moved up and down (trace of 'V3' and 'V4' in FIG. 10*b*), so that the air inside the housing is discharged, the housing having the first and second vibrating plates 620 and 621 mounted therein.

Accordingly, the heat-dissipating apparatus according to the present disclosure has an advantage that air suction and discharge are repeatedly performed while controlling the pressure of air inside the housing, by vibrating the vibrating plate, and high pressure air is contacted with the heat-dissipating pins outside the housing, thereby enhancing the heat-dissipating efficiency.

Further, the heat-dissipating apparatus of the present disclosure has an effect that air suction and discharge are performed using a plurality of air flow slots formed in the housing to increase the pressure of air jetted to the heat-dissipating pins from the inner housing much more, thereby quickening cooling of the heat transferred to the heat-dissipating pins.

Meanwhile, in the waveform view shown in FIG. 9, when controlling the magnitude of the sinusoidal wave current (A1 and A2) applied to the coil, it is possible to control vibrating width of the vibrating plates, and when controlling period (T) of the sinusoidal wave current, it is possible to control the number of vibrations of the vibrating plates per unit time.

Figure 11:
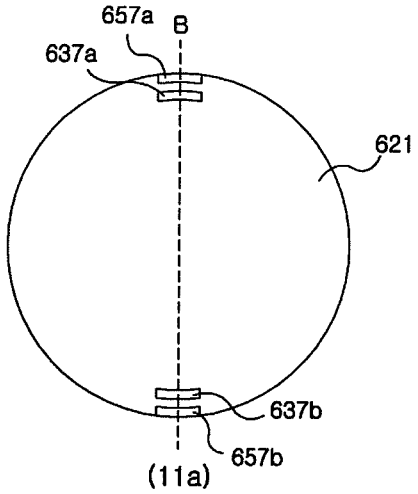
FIGS. 11*a* and 11*b* are schematic plane views explaining an example in which a magnet and a coil are arranged on first and second vibrating plates according to the present disclosure.
Figure 11:
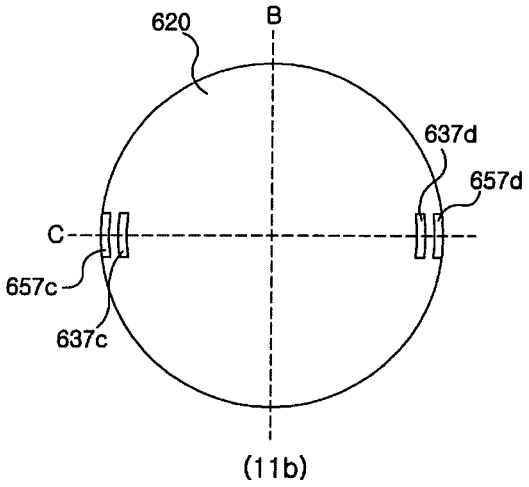

FIGS. 11*a* and 11*b* are schematic plane views explaining an example in which a magnet and a coil are arranged on first and second vibrating plates according to the present disclosure.

As described above, when vibrating phases of the first and second vibrating plates are opposite each other, the vibrations transferred outside from the driver are cancelled.

Therefore, arrangement of the magnets and coils on the first and second can be variously designed in order that the vibration phases of the first and second vibrating plates are opposite to each other.

That is, as shown in FIG. 11*a*, a first pair of a magnet 657*a* and a coil 637*a* and a second pair of a magnet 657*b* and a coil 637*b* are arranged on a first axis B of the second vibrating plate 621, and as shown in FIG. 11*b*, a third pair of a magnet 657*c* and a coil 637*c* and a fourth pair of a magnet 657*d* and a coil 637*d* are arranged on a second axis C of the first vibrating plate 620, the second axis C being perpendicularly crossed with the first axis B.

Figure 12:
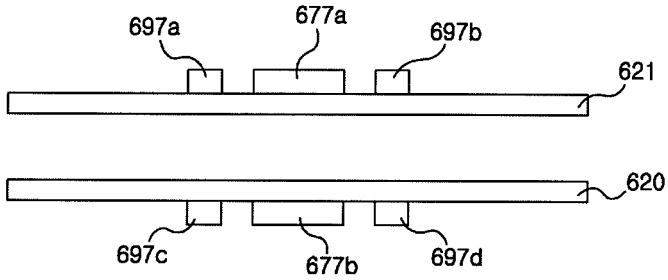
FIG. 12 is a schematic plane view explaining another example in which first and second vibrating plates have a magnet and a coil arranged therein, respectively, according to the present disclosure.

Further, as shown in FIG. 12, the first vibrating plate 620 has a magnet 677*b* and coils 697*c* and 697*d* arranged therebelow, the coils 697*c* and 697*d* being oppositely separated with each other on both sides of the magnet 677*b*, and the second vibrating plate 621 has a magnet 677*a* and coils 697*a* and 697*b* arranged thereon such that the magnet 677*a* and coils 697*a* and 697*b* are symmetrical to the magnet 677*b* and coils 697*c* and 697*d*, the coils 697*a* and 697*b* being oppositely separated with each other on both sides of the magnet 677*a*.

Figure 13:
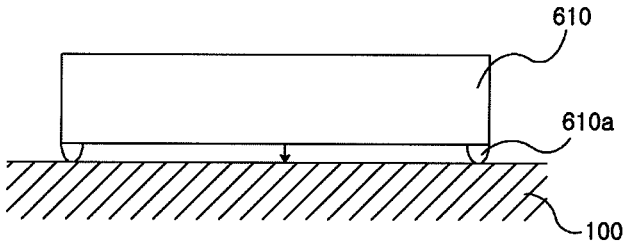
FIGS. 13*a* and 13*b* are schematic sectional views explaining a structure to stably vibrate vibrating plates according to the present invention.
Figure 13:
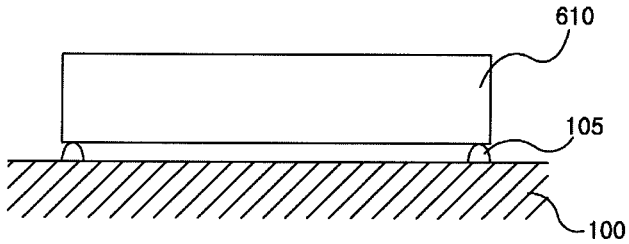

FIGS. 13*a* and 13*b* are schematic sectional views explaining a structure to stably vibrate vibrating plates according to the present invention.

The vibrating plates are mounted on both open sides (that is, the upper and lower sides) of the housing 610.

At this time, a space should be existed between the lower side of the housing 610 and the heat sink 100 in order to smoothly vibrate the vibrating plates mounted on the lower side of the housing 610.

Therefore, as shown in FIG. 13*a*, it is possible to provide a space between the lower side of the housing 610 and the heat sink 100 when a plurality of projections 610*a* is formed on the lower side of the housing 610 or a plurality of projections 105 is formed on the heat sink 100.

Figure 14:
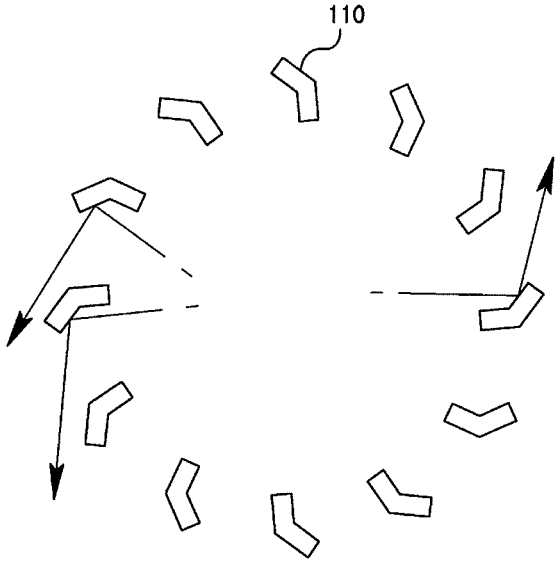
FIG. 14 is a conceptual sectional view showing examples of configuration of a light guide plate of an illuminator according to the present disclosure.

FIG. 14 is a conceptual sectional view showing examples of configuration of a light guide plate of an illuminator according to the present disclosure.

The heat sink has one side contacted with a heat generating portion, the other side having heat-dissipating pins arranged around it, a space formed inside the heat-dissipating pins and a driver positioned in the space.

While the heat-dissipating pins 110 are arranged on the edge of the other side of the heat sink, the pins having a predetermined space therebetween, it is desirable to have bent areas formed on the heat-dissipating pins 110 in order to efficiently receive the air flow pumped by the driver positioned inside the heat-dissipating pins, thereby increasing the heat-dissipating efficiency.

That is, as shown in FIG. 14, the flown air is contacted with the bent areas of the heat-dissipating pins 110 so that the heat-dissipating efficiency of the heat-dissipating pins 110 is enhanced.

Here, the heat-dissipating pins 110 have bent areas, so that the sectional shape of the heat-dissipating pins 110 can be appeared in a whirlwind pattern.

As a result, the bent areas of the heat-dissipating pins 110 increase area contacted with the flown air, thereby efficiently cooling the heat-dissipating pins 110.

Further, when the heat-dissipating pins 110 are arranged oppositely to each of a plurality of air flow slots formed in the housing, air jetted from each of the plurality of air flow slots is directly contacted with each of the heat-dissipating pins 110, so that the cooling efficiency of the heat-dissipating pins 110 can be increased.

Figure 15:
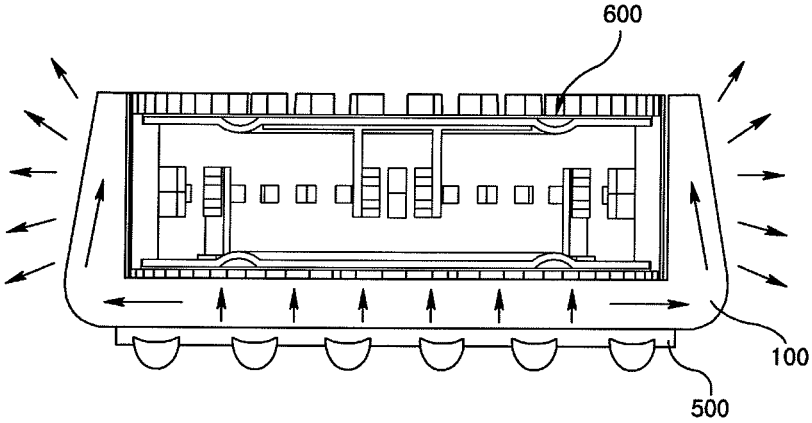
FIG. 15 is a view showing a state in which a heat-dissipating apparatus has an LED illumination module mounted therein according to the present disclosure.

FIG. 15 is a view showing a state in which a heat-dissipating apparatus has an LED illumination module mounted therein according to the present disclosure.

As described above, one side of the heat sink of the heat-dissipating apparatus is contacted with a heat generating portion defined as an electronic device that generates heat as it is driven, and when the heat generated in the heat generating portion is transferred to the heat-dissipating pins 110 from one side of the heat sink, the heat transferred to the heat-dissipating pins 110 can be efficiently dissipated by the air flow generated by the pumping operation of the driver 600.

As an example of such a heat generating portion, an LED illumination module is applied in FIG. 15.

Figure 16:
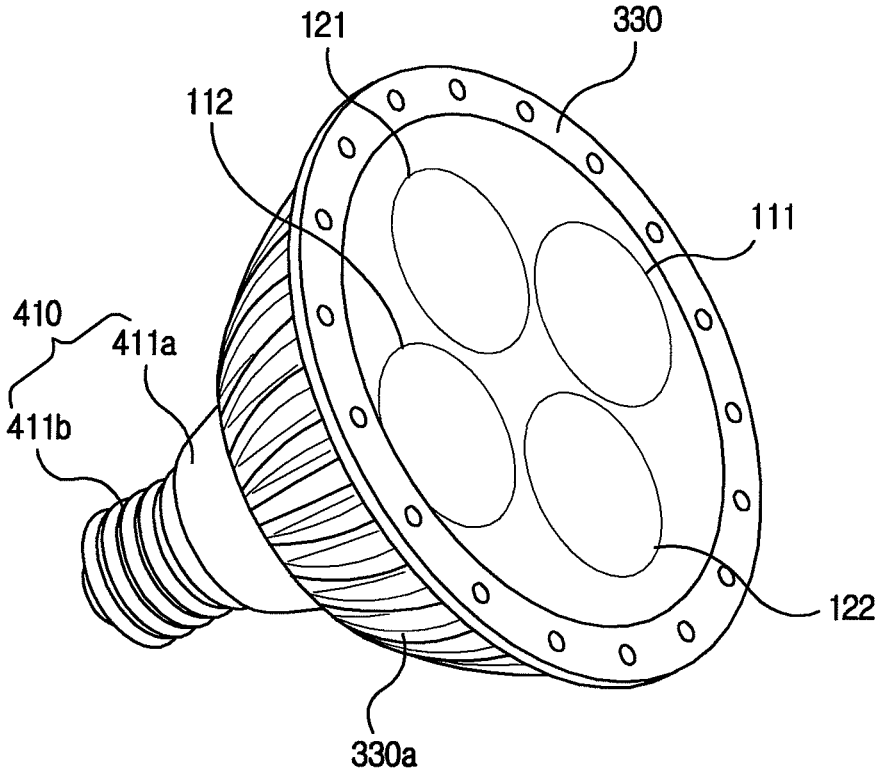
FIG. 16 is a schematic perspective view showing an illuminator according to a first embodiment of the present disclosure.
Figure 17:
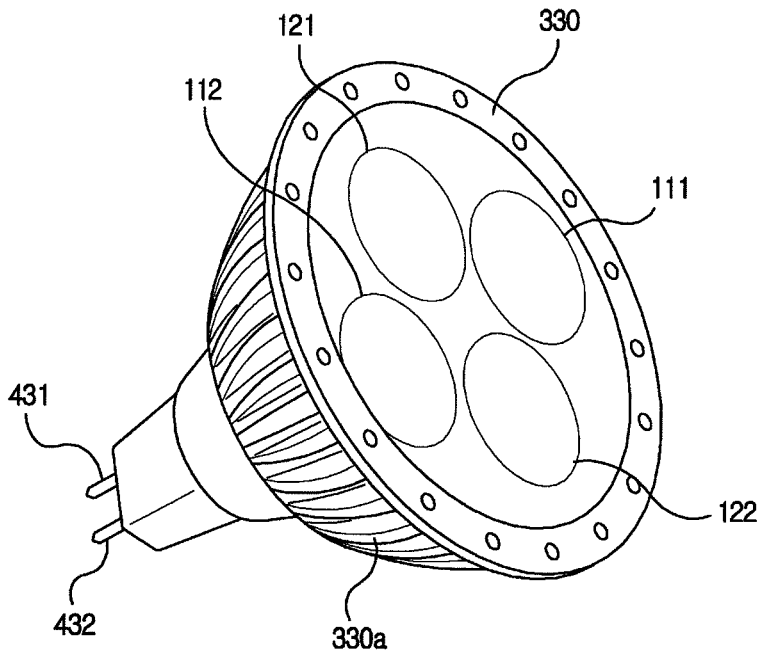
FIG. 17 is a schematic perspective view showing an illuminator according to a second embodiment of the present disclosure.
Figure 18:
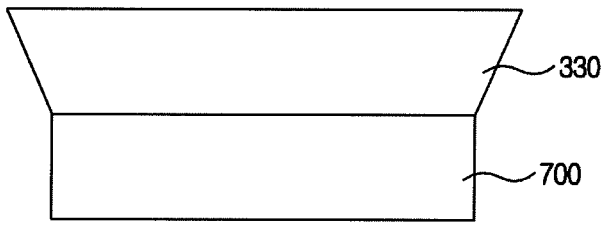
FIGS. 18 and 19 are schematic sectional views explaining a relationship between an active cooling portion and a heat sink that are applied to the present disclosure.
Figure 19:
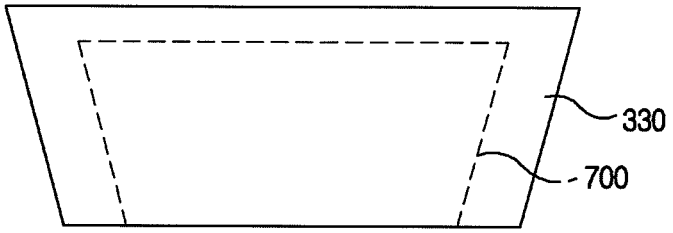

FIG. 16 is a schematic perspective view showing an illuminator according to a first embodiment of the present disclosure, FIG. 17 is a schematic perspective view showing an illuminator according to a second embodiment of the present disclosure, and FIGS. 18 and 19 are schematic sectional views explaining a relationship between an active cooling portion and a heat sink that are applied to the present disclosure.

An actuator including the above described driver to cool using the pumping or equivalent constitutional elements cooled by the pumping is referred to as 'an active cooling portion' which may be included in an illuminator described below.

First, the illuminator according to the first embodiment of the present disclosure includes a heat sink 330 having a plurality of pins 330*a* formed thereon; an active cooling portion (not shown) that is connected to the heat sink 330 and can cool the heat sink 330 by sucking or discharging outside air with a pumping operation; and light emitting diodes 111, 112, 121 and 122 that emit light and whose generated heat is transferred to the heat sink 330.

Here, the heat sink 330 may have a plurality of pins 330*a* on its outer circumference, the pins being separated from each other, and have openings (not shown) used to circulate air between the illuminator outside and the active cooling portion.

That is, the illuminator according to the first embodiment of the present disclosure makes an illumination using light emitted from the light emitting diodes 111, 112, 121 and 122, and the heat generated from the light emitting diodes 111, 112, 121 and 122 is dissipated out through the heat sink 330.

At this time, the active cooling portion connected to the heat sink 330 compulsorily produces air flow by repeatedly performing an operation of air suction from outside and air discharge to outside using a pumping operation, and cools the heat sink 330 and the plurality of pins 330*a*.

Additionally, the active cooling portion applies high pressure to the air flow by the pumping operation, and the heat sink 330 and the plurality of pins 330*a* that are contacted with the air having the high pressure experience an enhanced heat-dissipating efficiency.

Further, the illuminator according to the first embodiment of the present disclosure may include a transparent cover to protect the light emitting diodes 111, 112, 121 and 122 from outside influence.

For example, a structure of the illuminator according to the first embodiment of the present disclosure may include MR16 illuminator and PAR (Parabolic Aluminized Reflector) illuminator.

Further, the plurality of pins 330*a* has convection channels formed therebetween to transfer heat.

Further, the heat sink 330 has a through hole formed therein, a socket (not shown) having a driver to drive the light emitting diodes 111, 112, 121 and 122 is inserted into the through hole, and an E-base electrode structure 410 connected to the socket is projected outside the heat sink 330.

The E-base electrode structure 410 is constructed of a first electrode structure 411*a* which is spiral and a second electrode structure 411*b* that is projected on the end of the first electrode structure 411*a*.

Further, as shown in FIG. 17, a structure may be embodied that a socket may be mounted in the through hole inside the heat sink 330 in a 'two-pin type' and a pair of leads 431 and 432 connected to the socket are projected.

Additionally, an active cooling portion 700 may be attached to the heat sink 330 as shown in FIG. 18, and embedded inside the heat sink 330 as shown in FIG. 19.

Figure 20:
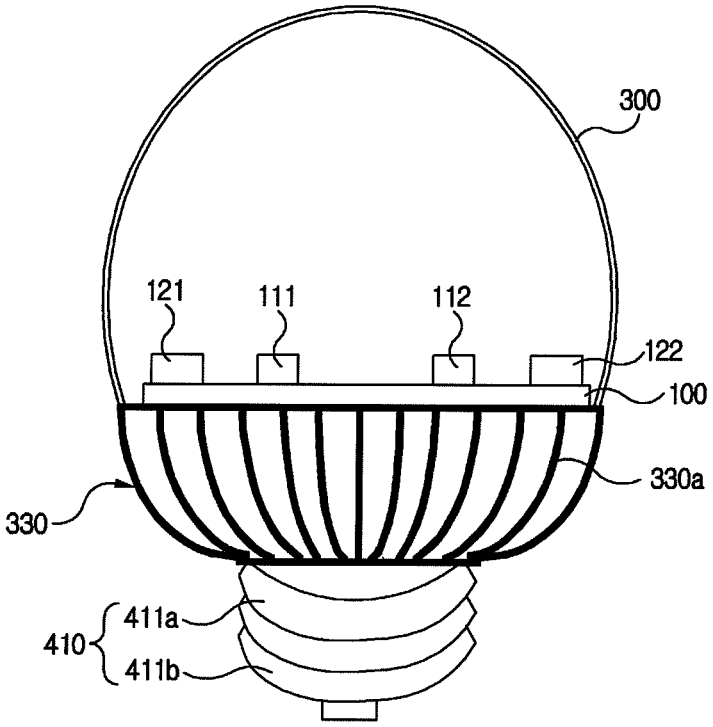
FIG. 20 is a schematic sectional view showing an illuminator according to a third embodiment of the present disclosure.

FIG. 20 is a schematic sectional view showing an illuminator according to a third embodiment of the present disclosure.

The illuminator according to the third embodiment of the present disclosure further includes a diffuser 300 that diffuses and transmits the light emitted from the light emitting diodes 111, 112, 121 and 122 in addition to the illuminator according to the first and second embodiments.

For example, the illuminator according to the third embodiment of the present disclosure includes an illuminator of a bulb type.

That is, the illuminator according to the third embodiment of the present disclosure includes a heat sink 330 having a plurality of pins 330*a* formed on the outer circumference thereof and openings (not shown) to circulate air therethrough, the pins being separated from each other; an active cooling portion (not shown) that is connected to the heat sink and can cool the heat sink 330 by sucking or discharging outside air with a pumping operation; light emitting diodes 111, 112, 121 and 122 that emit light and whose generated heat is transferred to the heat sink 330; and a diffuser 300 that diffuses and transmits light emitted from the light emitting diodes 111, 112, 121 and 122.

Further, the illuminator may further include a printed circuit board 100 having the light emitting diodes 111, 112, 121 and 122 mounted thereon.

Figure 21:
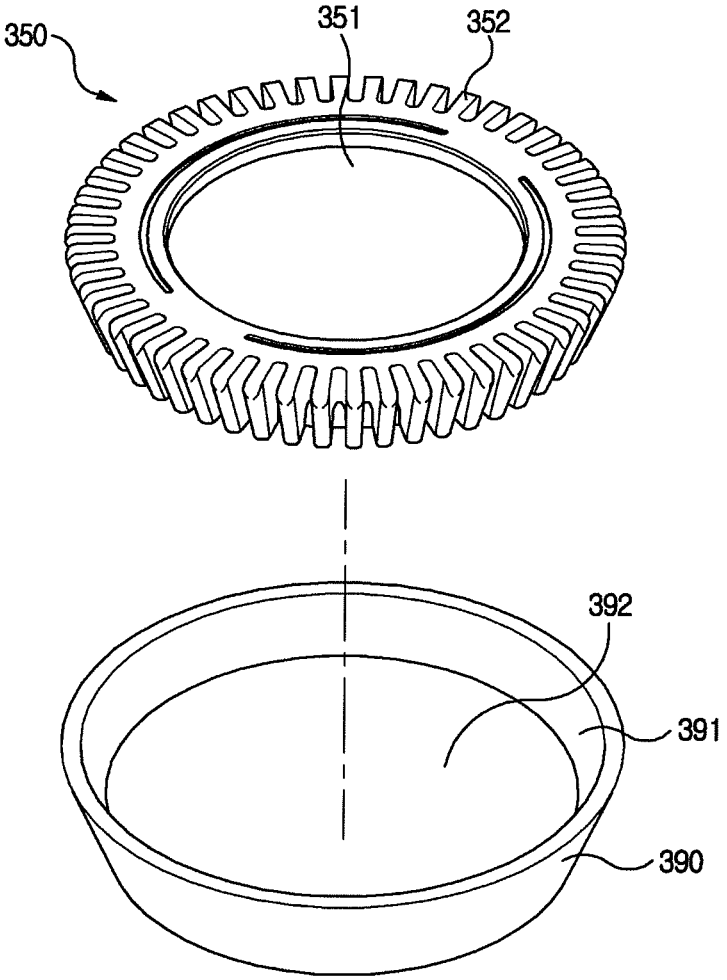
FIG. 21 is a schematic sectional view showing an illuminator according to a fourth embodiment of the present disclosure.

FIG. 21 is a schematic sectional view showing an illuminator according to a fourth embodiment of the present disclosure.

The illuminator according to the fourth embodiment of the present disclosure may be embodied in that the illuminator has a plurality of pins 352 formed on its side and light emitting diodes positioned in the inner area 351 of the heat sink 350.

For example, the heat sink 350 may be constructed in a disk shape as shown in FIG. 21.

Here, the light emitting diodes may be mounted on a printed circuit board and positioned in the inner area 351.

Further, a case 390 having an active cooling portion 392 mounted therein may be coupled with a lower side of the heat sink 350.

At this time, the heat sink 350 may include openings (not shown) through which outside air is circulated, and the openings may be existed between the pins 352.

Therefore, air sucked into or discharged from the active cooling portion 392 is circulated out through the openings.

Figure 22:
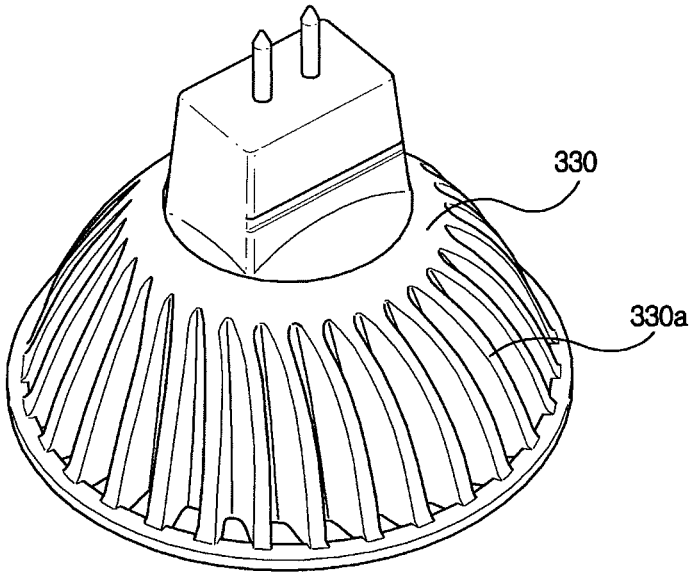
FIG. 22 is a schematic perspective view showing an illuminator according to a fourth embodiment of the present disclosure.

FIG. 22 is a schematic perspective view showing an illuminator according to a fourth embodiment of the present disclosure.

The plurality of pins 330*a* of the heat sink 330 may be constructed to be bent outside in a predetermined direction.

At this time, a convection channel to transfer heat between the plurality of pins 330*a* bent and the heat transferred to the plurality of pins 330*a* is dissipated outside through the convection channel formed between the plurality of pins 330*a*. At the same time, the heat is reflected in the bent area of the plurality of pins 330*a* and heat transfer speed is increased. Accordingly, the heat-dissipating efficiency is enhanced.

Here, the plurality of pins 330*a* may be constructed to bend in the opposite direction of light illuminated from the illuminator according to the fourth embodiment.

Hereinbefore, while the present disclosure is described in detail with respect to a detail example only, it is clear that one of ordinary skill in the art may recognize that various alterations and modifications that fall within the scope of the present disclosure may be possible, and the alterations and modifications are within following claims.

What is claimed is:

1. A heat-dissipating apparatus comprising:

a heat sink having one side configured to contact a heat generating portion and another side having a plurality of heat-dissipating pins arranged at the edge thereof, the plurality of heat-dissipating pins defining a space in the heat sink; and a driver positioned in the space, the driver configured to keep the heat-dissipating pins cool by sucking outside air into the driver and discharging inside air out of the driver with a pumping operation, the driver including:

a housing having a wall including a plurality of air flow slots formed therein, the wall defining a through hole such that the housing has a first open end and a second open end;

first and second vibrating plate respectively located in the first and second open ends in order to have opposite vibrating phases relative to each other; and an actuator assembly configured to vibrate the first and second vibrating plates such that inside air in the housing is discharged through the plurality of air flow slots and outside air is sucked into the housing through the plurality of air flow slots, the actuator assembly including:

a first actuator configured to vibrate the first vibrating plate; and a second actuator configured to vibrate the second vibrating plate, wherein the first vibrating plate includes first and second guide portions located thereon, the second vibrating plate has third and fourth guide portions located thereon, the housing includes a supporting portion extending from an inner surface of the wall of the housing, the first actuator includes first and second magnets mounted on the inner surface of the wall of the housing and first and second coils arranged opposite the first and second magnets, respectively, the first and second magnets being separated from each other and having upper and lower portions that are different in their polarities, and the first and second coils being wound on the first and second guide portions, respectively, and the second actuator includes a third magnet fixed to the supporting portion, the third magnet being formed in a shape of a square pillar, and third and fourth coils arranged at two sides around the third magnet, the third and fourth coils being oppositely formed relative to each other and separated from the third magnet.

2. The heat-dissipating apparatus according to claim 1, wherein each of the first and second actuators is configured to vibrate the first and second vibrating plates, respectively, using electromagnetic force generated between a magnet and a coil.

3. The heat-dissipating apparatus according to claim 1, further comprising a current applier configured such that a sinusoidal wave current is applied to the first to fourth coils such that the first and second vibrating plates oppositely move up and down relative to each other by being vibrated by the electromagnetic force respectively generated by the first to fourth coils and the first to third magnets.

4. The heat-dissipating apparatus according to claim 1, further comprising at least one of a plurality of projections formed on a lower surface of the housing and a plurality of projections formed on the heat sink.

5. The heat-dissipating apparatus according to claim 1, wherein the heat-dissipating pins are arranged opposite the air flow slots of the housing.

6. The heat-dissipating apparatus according to claim 1, wherein each of the heat-dissipating pins includes a bent portion.

7. The heat-dissipating apparatus according to claim 1, further including the heat generating portion, the heat generating portion including at least one of a light emitting diode illuminator, a central processing unit, a back light, a display apparatus, a hard disk drive, a portable terminal, a notebook computer, a computer module, and a projector.

8. The heat-dissipating apparatus according to claim 1, wherein the second actuator further includes two coils being arranged between the third and fourth coils, respectively, and arranged at two other sides around the third magnet, and the two coils are oppositely formed relative to each other and separated from the third magnet.

9. The heat-dissipating apparatus according to claim 1, wherein the first and second guide portions are arranged on a first axis and the third and fourth guide portions are arranged on a second axis, the second axis being formed perpendicular to the first axis.

10. An illuminator including:

a heat sink having a plurality of pins formed thereon;

an active cooling portion connected to the heat sink for cooling the heat sink by sucking or discharging outside air with a pumping operation; and a light emitting diode emitting light, where generated heat is transferred to the heat sink, wherein the active cooling portion includes:

a housing having a wall including a plurality of air flow slots formed therein, the wall defining a though hole such that the housing has a first open end and a second open end;

first and second vibrating plates respectively located in the first and second open ends in order to have opposite vibrating phases relative to each other; and an actuator assembly configured to vibrate the first and second vibrating plates such that inside air in the housing is discharged through the plurality of air flow slots and outside air is sucked into the housing through the plurality of air flow slots, the actuator assembly including:

a first actuator configured to vibrate the first vibrating plate; and a second actuator configured to vibrate the second vibrating plate, wherein the first vibrating plate includes first and second guide portions located thereon, the second vibrating plate has third and fourth guide portions located thereon, the housing includes a supporting portion extending from an inner surface of the wall of the housing, the first actuator includes first and second magnets mounted on the inner surface of the wall of the housing and first and second coils arranged opposite the first and second magnets, respectively, the first and second magnets being separated from each other and having upper and lower portions that are different in their polarities, and the first and second coils being wound on the first and second guide portions, respectively, and the second actuator includes a third magnet fixed to the supporting portion, the third magnet being formed in a shape of a square pillar, and third and fourth coils arranged at two sides around the third magnet, the third and fourth coils being oppositely formed relative to each other and separated from the third magnet.

11. The illuminator according to claim 10, wherein the heat sink has an opening through which air is circulated.

12. The illuminator according to claim 10, wherein the heat sink has a through hole formed therein, and the illuminator further includes:

a socket having a driver to drive the light emitting diode inserted into the through hole; and an E-base electrode structure connected to the socket, the E-base electrode extending outside the heat sink.

13. The illuminator according to claim 10, wherein the heat sink has a through hole formed therein, and the illuminator further includes:

a socket having a driver to drive the light emitting diode inserted into the through hole; and a pair of leads connected to the socket, the pair of leads extending outside the heat sink.

14. The illuminator according to claim 10, further comprising a diffuser configured to diffuse and transmit light emitted from the light emitting diode.

15. The illuminator according to claim 10, further including a printed circuit board on which the light emitting diode is mounted.

16. The illuminator according to claim 10, wherein the plurality of pins is formed on a side of the heat sink, and the light emitting diode is positioned in an inner area of the heat sink.

17. The illuminator according to claim 10, wherein the heat sink is coupled to a case, and the active cooling portion is located in the case.

18. The illuminator according to claim 10, wherein each of the plurality of pins is bent in a predetermined direction.

* * * * *